US005694790A

United States Patent [19]

Lavin

[11] Patent Number: 5,694,790

[45] Date of Patent: Dec. 9, 1997

[54] SEPARATION OF GAS MIXTURES

[75] Inventor: John Terence Lavin, Guildford, England

[73] Assignee: The BOC Group plc, Windlesham, England

[21] Appl. No.: 601,809

[22] Filed: Feb. 15, 1996

[30] Foreign Application Priority Data

Feb. 23, 1995 [GB] United Kingdom ..... 9503592

[51] Int. Cl.[6] ..... F25J 3/00

[52] U.S. Cl. ..... 62/640; 62/903

[58] Field of Search ..... 62/640, 903

[56] References Cited

U.S. PATENT DOCUMENTS 4,721,164 1/1988 Woodward ..... 62/903

5,207,065 5/1993 Lavin et al. ..... 62/903

5,461,870 10/1995 Paradowski ..... 62/903

*Primary Examiner*—Ronald C. Capossela

*Attorney, Agent, or Firm*—David M. Rosenblum; Salvatore P. Pace

[57] ABSTRACT

An heat exchange-cum-rectification apparatus comprises a heat exchanger having a first set of passages for separating by dephlegmation a first flow of compressed vaporous air into nitrogen-rich fluid and oxygen-enriched liquid air, and, in heat exchange relationship with said first set of passages, a second set of passages for separating by stripping reboiling an oxygen product from the oxygen-enriched liquid air. A valve is provided for reducing the pressure of the oxygen-enriched liquid air intermediate the said first and second sets of passages.

11 Claims, 1 Drawing Sheet

SEPARATION OF GAS MIXTURES

BACKGROUND OF THE INVENTION

This invention relates to the separation of gas mixtures. It particularly relates to the separation of air.

It is known to separate gas mixtures by dephlegmation, otherwise known as reflux condensation. Dephlegmation or reflux condensation is a method in which an ascending gaseous mixture is partially condensed with mass transfer between the liquid and vapour phases being achieved by arranging for the condensing liquid to fall countercurrently to the ascending vapour. The cooling duty for dephlegmation can typically be provided isothermally, for example, by boiling a pure refrigerant.

EP-A-0 479 486 discloses performing the rectification of air in a dephlegmator that takes the form of a plate fin heat exchanger having a plurality of sets of vertical passages. In a first set of passages, nitrogen-rich fluid is separated from a stream of air that has been compressed, pre-purified (by the removal of impurities of low volatility, particularly water vapour and carbon dioxide) and cooled to a temperature suitable for its separation by rectification. A liquid air stream, enriched in oxygen, is sub-cooled and passed through another set of the heat exchanger's passages countercurrently to the flow of vapour to the first set of passages. The necessary cooling is thus provided to condense vapour in the first set of passages and thus provide a downward reflux flow of liquid. Mass exchange thus takes place between ascending vapour and descending liquid with a result that the ascending vapour comes progressively richer in nitrogen and the descending liquid progressively richer in oxygen.

Such a method is however unable to produce an oxygen product containing 70% or more by volume of oxygen. It is an aim of the present invention to provide the method and apparatus for enabling a product containing at least 70% by volume of oxygen to be separated from air within the passages of the heat exchanger.

SUMMARY OF THE INVENTION

According to the present invention there is provided heat exchange-cum-rectification apparatus comprising (a) a heat exchanger having a first set of passages for separating by dephlegmation a first flow of compressed vaporous air into nitrogen-rich fluid and oxygen-enriched liquid air, and, in heat exchange relationship with said first set of passages, a second set of passages for separating by stripping reboiling an oxygen product from the oxygen-enriched liquid air, and (b) means for reducing the pressure of the oxygen-enriched liquid air intermediate the said first and second sets of passages.

The invention also provides a method for separating a flow of compressed vaporous air comprising subjecting the flow of air to dephlegmation in a first set of heat exchange passages so as to form nitrogen-rich fluid and oxygen-enriched liquid air, reducing the pressure of a stream of the oxygen-enriched liquid air, and separating by stripping reboiling an oxygen product from the pressure-reduced stream of the oxygen-enriched liquid in a second set of heat exchange passages in heat exchange relationship with the first set of passages.

By the term "stripping reboiling" as used herein is meant that the fluid which is subjected to this treatment is passed through heat exchange passages each having at least one heat transfer surface which is able to be heated to a temperature which causes a liquefied gas mixture of two or more components to boil and along which said liquefied gas mixture is able to flow in countercurrent mass exchange relationship with a vapour flow evolved from the liquefied gas member being boiled, whereby a more volatile component of the mixture is able to be progressively stripped from the flowing liquefied gas mixture such that the said vapour flow is enriched in the direction of its flow in the more volatile component of the mixture, and the liquefied gas mixture is progressively depleted in its direction of flow of said more volatile component.

Preferably, nitrogen-rich fluid is condensed in the first set of passages and a part of the condensate is reduced in pressure and employed as reflux in a fractionation region in which vapour from the second set of passages is brought into intimate contact and hence a mass transfer relationship with the reflux. As a result, nitrogen vapour may be formed. The fractionation zone may simply comprise a continuation of the second set of passages.

Preferably, the oxygen-enriched liquid air is sub-cooled in a further heat exchange region upstream of the said pressure reducing means. The sub-cooling is preferably performed by indirect heat exchange with a stream of nitrogen vapour withdrawn from the said fractionation region.

Preferably, that part of the condensed nitrogen-rich fluid that is reduced in pressure and employed as reflux in the said fractionation region is sub-cooled upstream of its reduction in pressure. The sub-cooling of the nitrogen-rich fluid is preferably performed by indirect heat exchange with nitrogen vapour taken from the said fractionation region. This nitrogen vapour preferably passes through the nitrogen-rich condensate sub-cooling region upstream of the oxygen-enriched liquid air sub-cooling region.

Preferably, all heat exchange in the method and apparatus according to the invention is performed in just two or three heat exchange blocks. In a first heat exchange block are located the said first and second heat exchange passages. In a second heat exchange block are located passages for cooling the flow of compressed air to a temperature suitable for its separation by rectification. If desired, a third heat exchange block may be used to effect the aforementioned sub-cooling.

By in effect conducting all fractionation and heat exchange in just two or three heat exchange blocks, a simple method and apparatus for separating an impure oxygen product from air. Moreover, the method and apparatus according to the invention make it possible to take some of the oxygen product in liquid state or to use liquid oxygen introduction from a separate source to vary the flow rate of oxygen product to meet a varying demand.

BRIEF DESCRIPTION OF THE DRAWING

The method and apparatus according to the invention will now be described by way of example with reference to the accompanying drawing which is a schematic flow diagram of an apparatus separating air in accordance with the invention.

The drawing is not to scale.

DETAILED DESCRIPTION

Figure 1:
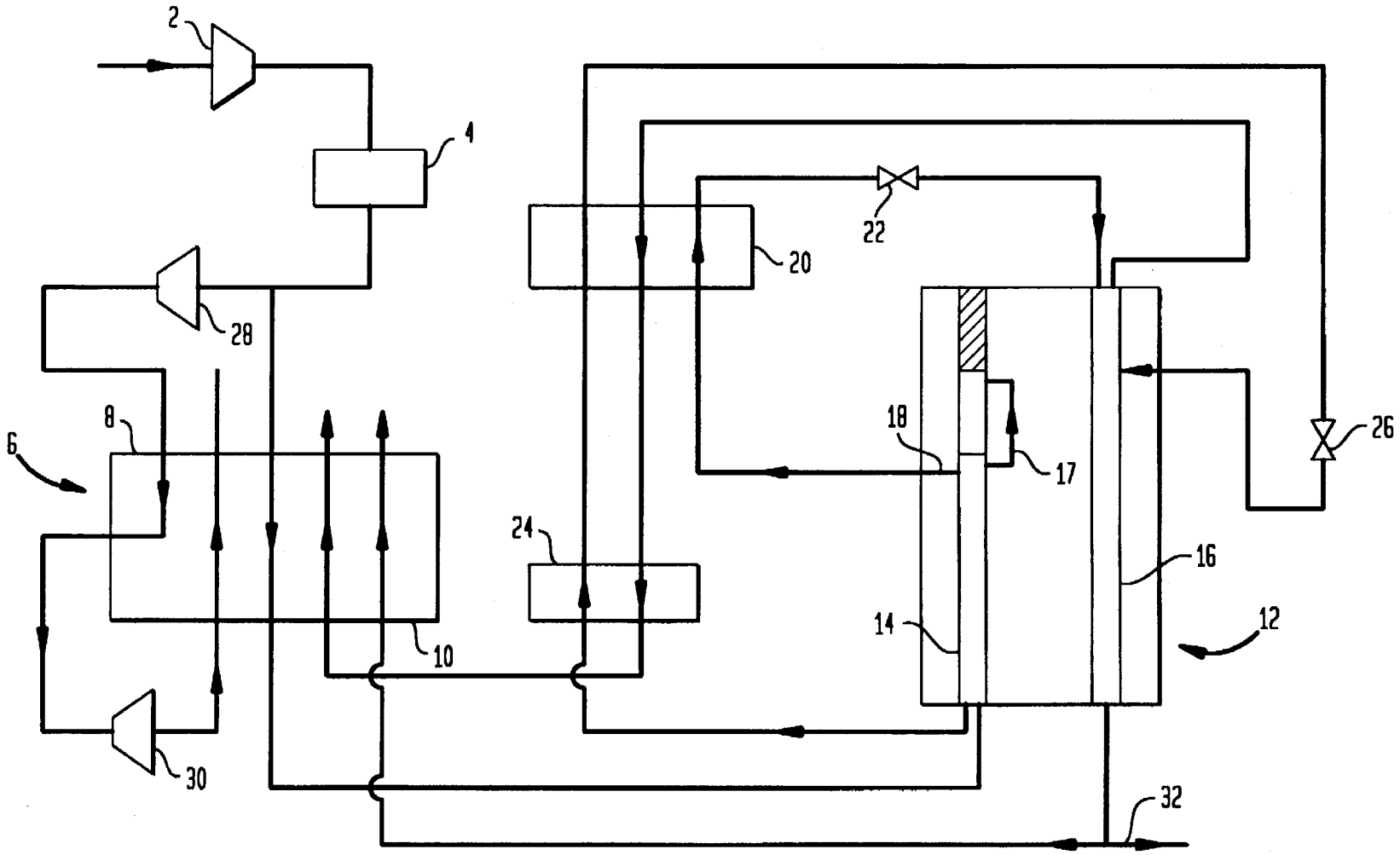

Referring to the drawing, air is compressed in a compressor 2. The compressed air is purified by means of a purification apparatus 4 which typically comprises a plurality of beds of adsorbent which selectively adsorbs carbon dioxide and water vapour from the incoming air as part of a pressure swing adsorption or temperature swing adsorption process. The construction and operation of such purification apparatus are well known in the art and need not be described further herein.

The purified air stream is divided into major and minor streams. The major stream flows through a heat exchanger 6 from its warm end 8 to its cold end 10 and is thereby cooled by heat exchange to a temperature suitable for its separation by rectification. The use to which the minor air stream is put will be described below.

The cooled major air stream is introduced to a second heat exchanger 12 which comprises a series of dephlegmator passages arranged alternately and in heat exchange relationship with a set of stripping reboiler passages. For the purpose of ease of illustration of the air separation process performed using the apparatus shown in the drawing, this drawing does not illustrate the dephlegmator passages and stripping reboiler passages as such. Rather, just one dephlegmator passage 14 and just one stripping reboiler passage 16 are shown.

Furthermore, these two passages are illustrated in the drawing as if they were separate from one another whereas in fact, as described above, they are passages within a single heat exchanger. All the dephlegmator passages in the heat exchanger 12 operate in essentially the same manner as described below with reference to the passage 14. Similarly, all the stripping reboiler passages in the heat exchanger 12 will operate in substantially the same way as described below with reference to stripping reboiler passage 16.

The cooled major air stream is introduced into the bottom of the dephlegmator passage 14. As the vapour flows up the dephlegmator passage 14, so it gives up heat to fluid flowing through the stripping reboiler passage 16. In addition, the vapour exchanges mass with a reflux stream flowing down a wall or walls of the passage 14. As a result, the vapour becomes in its direction of flow progressively richer in nitrogen (which is more volatile than argon or oxygen) while the descending reflux stream becomes in the direction of its flow progressively richer in oxygen (which is less volatile than argon or nitrogen). At a region near the top of the dephlegmator passage 14, the vapour has been sufficiently denuded of oxygen and argon for it to contain at least 99% by volume of nitrogen. Nitrogen vapour of this composition is withdrawn from this region through the outlet 17 and is introduced back into the passage 14 at a region thereabove. Extraction of heat from the top region of the dephlegmator passage 14 causes the nitrogen vapour to condense. A part of the condensate forms the reflux flow down a wall or walls of the dephlegmator passage 14. The remainder of the condensate is taken from the dephlegmator passage 14 through an outlet 18, is sub-cooled in a further heat exchanger 20, is passed through a throttling or pressure reduction valve 22 and is introduced into the top of the stripping reboiler passage 16.

The liquid flowing down the dephlegmator passage 14 is converted into oxygen-enriched liquid air by its progressive enrichment in oxygen. Its oxygen content at the bottom of the passage is typically less than that which would be in equilibrium with the cooled major air stream entering the dephlegmator passage 14 at the bottom. The oxygen-enriched liquid air is withdrawn as a stream from the bottom of the dephlegmator passage 14 and is sub-cooled by passage through yet further heat exchanger 24 and the heat exchanger 20. The sub-cooled oxygen-enriched liquid air stream is passed through a throttling or pressure reduction valve 26 and is introduced into the stripping reboiler passage 16 at a level below that at which the sub-cooled condensed nitrogen stream enters.

The whole extent of the stripping reboiler passage 16 below the level at which the sub-cooled oxygen-condensing liquid air stream enters is in heat exchange relationship with the dephlegmator passage 14 (including the top section above the outlet 17). The oxygen-enriched liquid air flows down a wall or walls of the stripping reboiler passage 16 and is vaporised. The arrangement is such that the vapour so-formed flows in countercurrent direction to that of the liquid and in contact therewith. The most volatile component (nitrogen) of the liquid is thereby progressively stripped from the downwardly flowing liquid with the result that the vapour flow becomes in its direction of flow progressively richer in nitrogen and the liquid in the direction of its flow progressively richer in oxygen. It is accordingly possible to obtain an oxygen product typically containing from 85–95% by volume of oxygen at the bottom of the stripping reboiler passage 16.

Whereas that part of the stripping reboiler passage 16 below the level at which the sub-cooled oxygen-enriched liquid air enters is in heat exchange relationship with fluid in the passage 14, no such heat exchange relationship typically obtains in that part of the passage above the entry of the sub-cooled oxygen-enriched liquid air. In this part of the passage there is nonetheless mass exchange between ascending vapour, created by the effective partial reboiling of liquid therebelow, with descending liquid nitrogen that is introduced from the valve 22 into the top of the passage. Accordingly, there is provided a flow of nitrogen vapour out of the top of the passage 16 sufficient to provide the necessary cooling for the aforementioned streams flowing through the heat exchangers 20 and 24. The nitrogen stream flows from the top of the passage 16 through the heat exchangers 20, 24 and 6 in sequence and may be vented to the atmosphere at approximately ambient temperature from the warm end 8 of the heat exchanger 6. Alternatively, it may be taken as product.

A liquid oxygen stream is withdrawn from the bottom of the stripping reboiler passage 16. If desired, a small proportion, typically from 5 to 10% by volume, of this stream may be collected as product in the liquid state via a conduit 32. The rest of the stream is passed through the heat exchanger 6 from its cold end 10 to its warm end 8 and is thereby vaporised and warmed to approximately ambient temperature. The resulting vaporised oxygen may be collected as product.

The process has a requirement for external refrigeration not only so as to liquefy a proportion of the oxygen product but also to compensate for absorption of heat from the environment into those parts of the apparatus that operate at below ambient temperature. In the apparatus shown in FIG. 1, the minor air stream is employed to create this refrigeration. The minor air stream is further compressed in a booster compressor 28 which (like the compressor 2) has an after cooler (not shown) associated therewith to remove the heat of compression. The resulting further compressed minor air stream is cooled by passage through the heat exchanger 6 from its warm end 8 to an intermediate region thereof. The resulting cooled air is withdrawn from the intermediate region of the heat exchanger 6 and is expanded with the performance of external work in a turbine 30. The minor air stream leaves the turbine 30 to temperature below that at which the major air stream leaves the cold end 10 of the main heat exchanger 6. The expanded minor air stream is returned through the heat exchanger 6 from its cold end 10 to its warm end 8 and is thereby warmed to approximately ambient temperature. The minor air stream therefore provides necessary refrigeration for the process.

Typically, the turbine 30 is mechanically coupled to the booster compressor 28 such that the turbine 30 performs all the work of compression in the compressor 28.

The stripping reboiler passage 16 is operated at a lower pressure than the dephlegmator passage 14. The pressures are chosen so as to give an appropriate temperature difference at a given level of the heat exchanger 12 between the fluid being warmed in the stripping reboiler passage and that being cooled in the dephlegmator passage. This temperature difference may typically be in the range of 1–2K.

Various changes and modifications may be made to the apparatus shown in FIG. 1 and its operation without departing from the invention. For example, the purification unit 4 may be dispensed with and the heat exchanger 6 constructed and operated at a reversing heat exchanger in order to remove the carbon dioxide and water vapour impurities. It is also, for example, possible to dispense with the minor air stream and therefore the booster compressor 28 and turbine 30 and instead provide for refrigeration of the apparatus by introduction of liquid nitrogen from an external source into the top of the stripping reboiler passages. It is also possible to introduce liquid oxygen at the bottom of the stripping reboiler passages so as to enable oxygen product to be produced at a variable rate to meet a fluctuating demand.

In a typical example, the oxygen-enriched liquid air is introduced into the passage 16 at a height five meters above its bottom and one meter from its top, whereas the outlets 17 and 18 are positioned four meters above the bottom of the passage 14. The condensing section of the passage 14 above the outlets 17 and 18 is one meter high. Thus, the top one meter of the passage 14 is blanked off, i.e. closed to the passage of fluid.

An example of the operation of the apparatus shown in FIG. 1 is given in the Table below:

TABLE

| Description of Stream | Flow rate $sm^3/hr$ | Temperature K. | Pressure Bar | mole fraction $O_2$ | Ar | $N_2$ | State |
|---|---|---|---|---|---|---|---|
| Major air stream at warm end 8 of heat exchanger 6 | 1000 | 300.0 | 4.0 | 0.21 | 0.01 | 0.78 | V |
| Major air stream at cold end 10 of heat exchanger 6 | 1000 | 94.9 | 4.0 | 0.21 | 0.01 | 0.78 | V |
| Minor air stream at outlet of compressor 28 (downstream of the aftercooler) | 170 | 300.0 | 16.0 | 0.21 | 0.01 | 0.78 | V |
| Minor air stream at inlet to turbine 30 | 170 | 160.0 | 16.0 | 0.21 | 0.01 | 0.78 | V |
| Minor air stream at outlet from turbine 30 | 170 | 83.1 | 1.1 | 0.21 | 0.01 | 0.78 | V |
| Minor air stream downstream of turbine 30 at warm end 8 of heat exchanger 6 | 170 | 296.4 | 1.0 | 0.21 | 0.01 | 0.78 | V |
| Oxygen-enriched liquid air stream at its inlet to heat exchanger 24 | 888 | 93.6 | 4.0 | 0.24 | 0.01 | 0.75 | L |
| Oxygen-enriched liquid air stream at its outlet from heat exchanger 20 | 888 | 89.0 | 4.0 | 0.24 | 0.01 | 0.75 | L |
| Oxygen-enriched liquid air stream at its outlet from valve 26 | 888 | 80.7 | 1.2 | 0.24 | 0.01 | 0.75 | L |
| Liquid nitrogen condensate stream at its inlet to heat exchanger 20 | 112 | 90.6 | 3.8 | — | 0.01 | 0.99 | L |
| Liquid nitrogen condensate at its outlet from heat exchanger 20 | 112 | 82.0 | 3.8 | — | 0.01 | 0.99 | L |
| Liquid nitrogen condensate at its outlet from valve 22 | 112 | 78.7 | 1.2 | — | 0.01 | 0.99 | L |
| Gaseous nitrogen flow from top of stripping reboiler passages | 818 | 80.1 | 1.0 | 0.06 | — | 0.94 | V |
| Gaseous nitrogen at warm end 8 of heat exchanger 6 | 818 | 296 | 1.0 | 0.06 | — | 0.94 | V |
| Liquid oxygen flow from bottom of stripping reboiler passages | 182 | 91.7 | 1.4 | 0.91 | 0.03 | 0.06 | L |
| Liquid oxygen product | 15 | 91.7 | 1.4 | 0.91 | 0.03 | 0.06 | L |
| Gaseous oxygen product at warm end 8 of heat exchanger 6 | 167 | 2964 | 1.3 | 0.91 | 0.03 | 0.06 | V |

Notes:
L = liquid;
V = vapour or gas.
For simplification of calculations, 100% recovery of oxygen and essentially no pressure drop through the heat exchangers are assumed. In practice, of course, such results are impossible to achieve. The example is thus merely indicative in nature.

I claim:

1. An apparatus comprising (a) a heat exchanger having a first set of passages for separating by dephlegmation a first flow of compressed vaporous air into nitrogen-rich fluid and oxygen-enriched liquid air, and a second set of passages connected to said first set of passages for receiving said oxygen-enriched liquid air, thereby to separate by stripping reboiling an oxygen product from the oxygen-enriched liquid air, each of the first and second passages having a top and a bottom, the second passages alternating with and in a heat exchange relationship with said first set of passages and the top of said second passages connected to the bottom of said first passages so that said second passages are refluxed with said oxygen-enriched liquid air, and (b) means for reducing the pressure of the oxygen-enriched liquid air intermediate the said first and second sets of passages.

2. The apparatus as claimed in claim 1, additionally including means for reducing in pressure nitrogen-rich fluid condensed in the first set of passages, and a fractionation region for bringing said pressure-reduced nitrogen-rich condensate into intimate contact and hence mass transfer relationship with vapour from the second set of passages.

3. The apparatus as claimed in claim 2, additionally including heat exchange means for sub-cooling the nitrogen-rich condensate upstream of the means for reducing the pressure of the nitrogen-rich condensate.

4. The apparatus as claimed in claim 2, wherein the fractionation region comprises an extension of the second set of passages above the top thereof.

5. The apparatus as claimed in claim 1, wherein the apparatus comprises two heat exchange blocks for performing heat exchange, there being a first heat exchange block in which are located the first and second heat exchange passages, and a second heat exchange block defining passages for cooling the flow of compressed air to a temperature suitable for its separation by rectification.

6. The apparatus as claimed in claim 1, additionally including heat exchange means for sub-cooling the oxygen-enriched liquid air upstream of the means for reducing the pressure of the oxygen-enriched liquid air.

7. A method for separating a flow of compressed vaporous air comprising subjecting the flow of air to dephlegmation in a first set of heat exchange passages so as to form nitrogen-rich fluid and oxygen-enriched liquid air, pressure reducing the oxygen-enriched liquid air, and separating by stripping reboiling an oxygen product from the pressure-reduced stream of the oxygen-enriched liquid air in a second set of heat exchange passages in heat exchange relationship with the first set of passages.

8. The method as claimed in claim 7, in which nitrogen-rich fluid is condensed in the first set of passages and a part of the condensate is reduced in pressure and employed as reflux in a fractional region in which vapour from the second set of passages is brought into intimate contact and hence a mass transfer relationship with the reflux.

9. The method as claimed in claim 8, in which that part of the condensed nitrogen-rich fluid that is reduced in pressure and employed as reflux in the said fractionation region is sub-cooled upstream of its reduction in pressure.

10. The method as claimed in claim 9, wherein the sub-cooling of the nitrogen-rich condensate is performed by indirect heat exchange with nitrogen taken from the said fractionation region.

11. The method as claimed in claim 7, wherein the oxygen-enriched liquid air is sub-cooled in a further heat exchange region upstream of its pressure reduction.

* * * * *